US007868731B2

(12) United States Patent
Furuhata et al.

(10) Patent No.: US 7,868,731 B2
(45) Date of Patent: Jan. 11, 2011

(54) THERMAL OVERLOAD RELAY

(75) Inventors: Yukinari Furuhata, Konosu (JP); Fumihiro Morishita, Saitama (JP); Takeo Kamosaki, Saitama (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 122 days.

(21) Appl. No.: 12/318,467

(22) Filed: Dec. 30, 2008

(65) Prior Publication Data

US 2009/0206977 A1 Aug. 20, 2009

(30) Foreign Application Priority Data

Feb. 19, 2008 (JP) ..... 2008-037106
Oct. 6, 2008 (JP) ..... 2008-259294

(51) Int. Cl.
*H01H 71/74* (2006.01)
*H01H 71/16* (2006.01)

(52) U.S. Cl. ..... 337/84; 337/37; 337/82; 337/94; 337/95; 337/129; 337/319; 337/347; 337/357; 337/360; 337/361; 337/368; 337/392; 335/35; 335/45

(58) Field of Classification Search ..... 337/37, 337/82, 84, 94, 95, 129, 319, 347, 357, 360, 337/361, 368, 392; 335/35, 45
See application file for complete search history.

(56) References Cited

U.S. PATENT DOCUMENTS 3,162,739 A * 12/1964 Klein et al. ..... 335/9
3,183,328 A * 5/1965 Wheeler ..... 337/56
3,197,595 A * 7/1965 Weber ..... 337/313
3,251,966 A * 5/1966 Kussy et al. ..... 337/45
3,588,761 A * 6/1971 Heft et al. ..... 335/16
3,683,304 A * 8/1972 Freeby ..... 337/347
4,603,312 A * 7/1986 Conner ..... 335/42
4,635,020 A * 1/1987 Sako ..... 337/49
4,642,597 A * 2/1987 Sako ..... 337/82
4,808,961 A * 2/1989 Sako et al. ..... 337/49
4,912,598 A * 3/1990 Grass ..... 361/652
5,767,762 A * 6/1998 Sako ..... 337/348
6,459,355 B1 10/2002 Furuhata et al.
6,661,329 B1 * 12/2003 Gibson ..... 337/84
7,714,692 B2 * 5/2010 Lee ..... 337/84
2008/0122563 A1 * 5/2008 Song ..... 335/176

FOREIGN PATENT DOCUMENTS

JP S53-95168 U 8/1978

* cited by examiner

*Primary Examiner*—Anatoly Vortman
(74) *Attorney, Agent, or Firm*—Kanesaka Berner & Partners

(57) ABSTRACT

A thermal overload relay is provided with an external case, and an adjustment dial with a cam inserted into an adjustment dial insertion hole provided in the external case for adjusting a settling current. A press-fitting section is provided at one of the adjustment dial and the adjustment dial insertion hole, and a locking section is provided at the other of the adjustment dial and the adjustment dial insertion hole. The press-fitting section is press-fit and retained in the locking section.

12 Claims, 6 Drawing Sheets

THERMAL OVERLOAD RELAY

BACKGROUND OF THE INVENTION AND RELATE ART STATEMENT

The present invention relates to a thermal overload relay (thermal relay) used in combination with an electromagnetic contactor and the like, and more particularly, to a retaining structure of an adjustment dial thereof.

An explanation is first provided for a conventional structure of the above-mentioned thermal overload relay with reference to FIG. 12. In FIG. 12, reference symbol 1 indicates a molded plastic external case, 2 a main bimetal that is bent by heat generated by a heater connected to a main circuit, 3 a shifter coupled to the free end of the main bimetal 2, 4 a releasing lever driven by displacement of the shifter 3, 5 an inversion operation mechanism for opening or closing a contact, 6 a normally closed contact comprising a movable contact 6*a* and a fixed contact 6*b*, 7 a normally open contact comprising a fixed contact 7*a* and a movable contact 7*b* provided on a movable contact shoe piece, 8 an adjustment link having a lower end supported in a case slot 1*a* provided in the external case 1 and being coupled to a proximal end of the releasing lever 4 at a support point 4*a*, and 9 an adjustment dial comprising a head section 9*c* (FIG. 13) and a shaft section 9*g* and having a cam surface 9*a* on the lower end of the shaft section 9*g*, an upper end 8*a* of the adjustment link 8 contacting the cam surface 9*a*.

Furthermore, a current adjustment hole 9*d* is a hole for inserting a screwdriver for adjusting settling current, and current setting scale 9*e* is a scale for aligning with an indicated value provided on the external case 1. Here, the inversion operation mechanism 5 comprises a pivotally movable plate 11 having one end locked and supported in a V-shaped groove 10*a* of a generally U-shaped support piece 10, a tension spring 12 extending between a distal end section 11*a* of the movable plate 11 and a spring catching section 10*b* of the support piece 10, and a normally open contact drive lever 13 protruding towards the back from the movable plate 11 in the shape of the letter L, and the movable contact 6*a* of the normally closed contact 6 is attached to the distal end section of the movable plate 11. In addition, the fixed contact 6*b* of the normally closed contact 6 has one end fixed to the bottom of the external case 1 and is attached to a contact supporting piece 14 having a flat spring structure lying in the horizontal direction.

The tension spring 12 has a coil-like spring section 12*a* formed of a wire of a spring steel material and a protruding section 12*b* formed to protrude into the center of the tensile spring 12, and has hook sections formed on both ends thereof. With this configuration, in the steady state shown in FIG. 12, the movable plate 11 of the inversion operation mechanism 5 tilts in the clockwise direction from its neutral position due to spring force applied from the tension spring 12, and the movable contact 6*a* of the normally closed contact 6 presses against the fixed contact 6*b* to maintain the contact in the "on" state. Furthermore, the normally open contact 7 is "off" in this state.

Here, when an overload current flows through a main circuit, the main bimetal 2 is heated and bent, and the shifter 3 moves to the right due to displacement of the free end thereof. As a result, releasing lever 4 pivots around a support point 4*a*. At this time, in addition to the projecting section 12*b* of the tension spring 12 of the inversion operation mechanism 5 being pushed upward, when the displacement of the tension spring 12 exceeds a dead point of the movable plate 11, the movable plate 11 is rapidly driven to be inverted, and together with the movable contact 6*a* of the normally closed contact 6 separating from the fixed contact 6*b*, a movable contact show piece to which movable contact 7*b* is attached is pressed by the drive lever 13, and the movable contact 7*b* contacts the fixed contact 7*a* to turn on the contact (see, for example, Patent document 1).

Next, an explanation is provided for a method for adjusting a settling current value of a thermal overload relay based on FIG. 12. In FIG. 12, when the adjustment dial 9 is rotated, the adjustment link 8, having the upper end 8*a* contacting the cam surface 9*a*, is displaced by using the case slot 1*a* of the external case 1 as a support point. Accompanying this, the releasing lever 4 coupled to the adjustment link 8 can be displaced and moved to change the gap between the releasing lever 4 and a distal end of the shifter 3.

Here, an explanation is provided for a method of retaining the adjusting dial 9 in an adjustment dial insertion hole 1*b* provided in the external case 1 based on FIG. 13. In FIG. 13, in order to retain the adjustment dial 9 at a prescribed incorporated position, a wire spring 15, obtained by bending a spring wire material (such as a piano wire) to a shape like that shown in FIG. 13, is disposed as shown in FIG. 10, and the adjustment dial 9 is pressed and held at a fixed position by the spring reaction force thereof. In addition, Patent document 2 discloses a configuration in which an adjustment dial is retained by a handle linking bracket and a pressing spring.

Patent document 1: Japanese Patent Application Laid-open No. 2001-160346, corresponding U.S. Pat. No. 6,459,355 B1

Patent document 2: Japanese Utility Model Application Laid-open No. S53-95168

However, in a thermal overload relay of the prior art as described above, a wire spring 15 or other part is required to retain the adjustment dial 9 at a fixed position, thereby resulting in the problems of increasing the number of parts and number of assembly steps during product assembly as well as increasing costs.

With the foregoing, an object of the present invention is to provide a thermal overload relay having an improved structure for retaining the adjustment dial 9 so as to enable the adjustment dial 9 to be stably retained in the external case 1 without increasing the number of parts.

Further objects and advantages of the invention will be apparent from the following description of the invention.

SUMMARY OF THE INVENTION

In order to achieve the above-mentioned object, according to the present invention, in a thermal overload relay provided with an external case, and an adjustment dial with a cam that is inserted into an adjustment dial insertion hole provided in the external case and that adjusts a settling current, a press-fitting section is provided in one of the adjustment dial and the adjustment dial insertion hole, and a locking section in which the press-fitting section is press-fit and retained is provided in the other (the first aspect). In addition, the thermal overload relay can be configured in the specific modes described below.

(1) The press-fitting section is provided on the adjustment dial, and the locking section is provided in the adjustment dial insertion hole of the external case (the second aspect).

(2) The press-fitting section provided on the adjustment dial is provided with a projection on the outer periphery of the adjustment dial that contacts the locking section of the adjustment dial insertion hole of the external case (the third aspect).

(3) The locking section provided on the case is in the form of a chambered section (inclined section) (the forth aspect).

(4) The projection provided on the outer periphery of the adjustment dial is provided around the entire periphery (the fifth aspect).

(5) The projection of the press-fitting section provided on the adjustment dial is provided at three locations or more at equal intervals on the outer periphery thereof (the sixth aspect).

(6) The adjustment dial insertion hole has a triangular shape, and an adjustment dial contact surface of the adjustment dial insertion hole is in the form of a locking section provided on the external case (the seventh aspect).

(7) A shaft section of the adjustment dial is of a size sufficient to contact the adjustment dial contact surface so that the shaft section contacts the adjustment dial contact surface (the eighth aspect).

According to the above-mentioned configuration, although a spring member or other parts were used to retain an adjustment dial in the prior art, since the adjustment dial can be stably retained at a fixed position with the adjustment dial alone, the number of parts and number of assembly steps are decreased and costs are reduced.

DETAILED DESCRIPTION OF PREFERRED EMBODIMENTS

The following provides an explanation of a specific mode for carrying out the present invention based on the embodiments shown in FIGS. 1 to 11.

Figure 1:
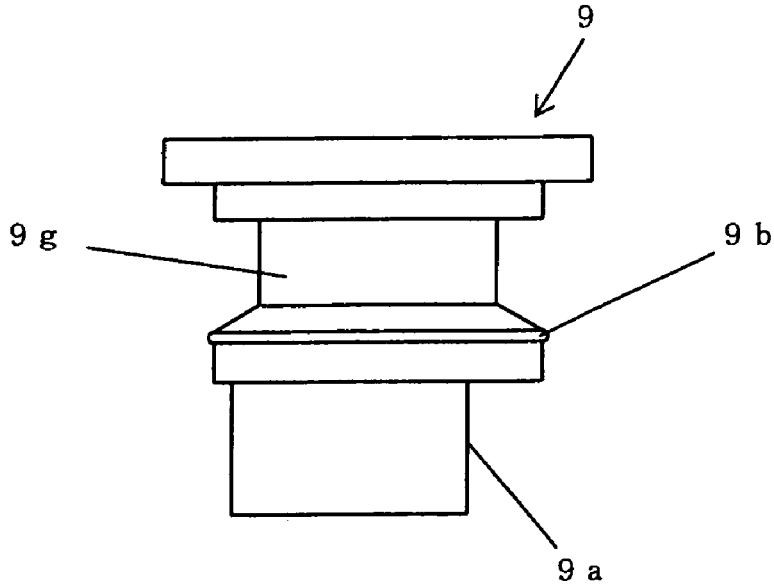
FIG. 1 is a frontal view showing an adjustment dial indicating an embodiment of the present invention.
Figure 2:
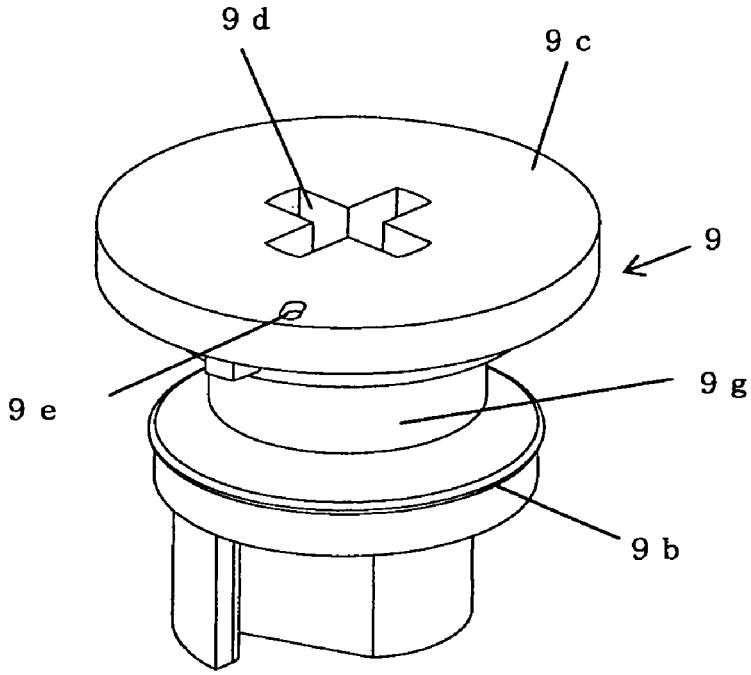
FIG. 2 is a perspective view of the adjustment dial shown in FIG. 1.
Figure 3:
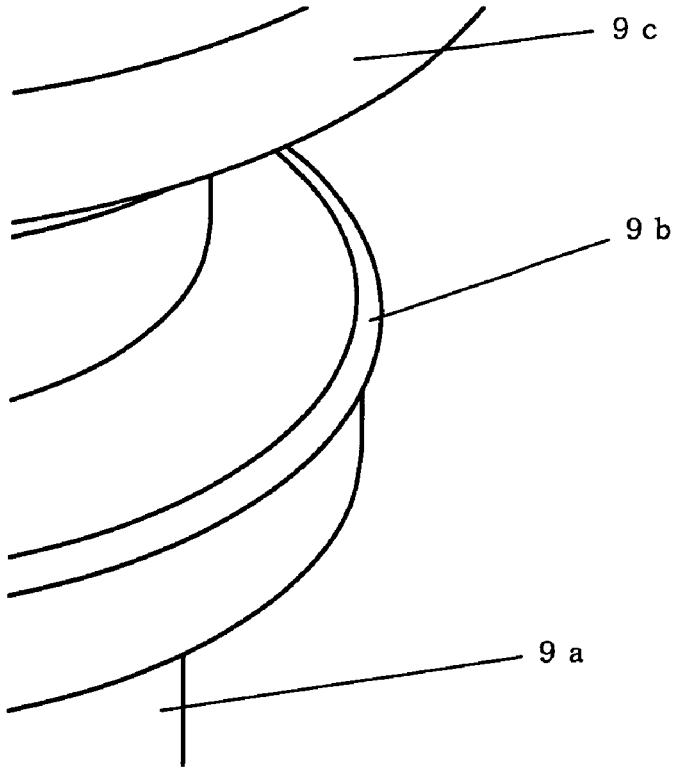
FIG. 3 is an enlarged view of the press-fitting section of the adjustment dial shown in FIG. 2.

FIG. 1 is a front view showing an adjustment dial of a thermal overload relay of the present invention, FIG. 2 is a perspective view of the adjustment dial shown in FIG. 1, and FIG. 3 is an enlarged view of the press-fitting section (projection) shown in FIG. 2.

Figure 4:
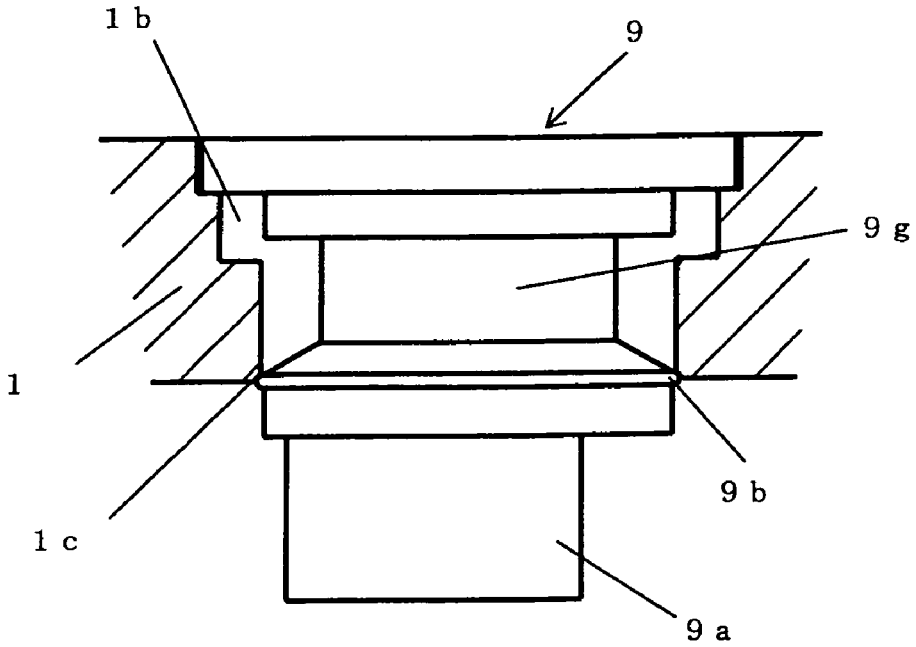
FIG. 4 is a cross-sectional view showing the adjustment dial incorporated in an embodiment of the present invention.
Figure 5:
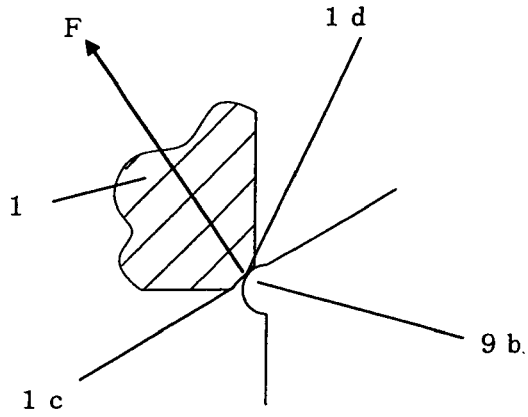
FIG. 5 is an enlarged view showing the press-fitting section of the adjustment dial shown in FIG. 4 engaged with a locking section of an external case.

FIG. 4 is a cross-sectional view showing an adjustment dial of the present invention press-fit and retained in an adjustment dial insertion hole provided in an external case, and FIG. 5 is an enlarged view of the press-fitting section of the adjustment dial shown in FIG. 4 engaged with the external case.

Namely, in the embodiment shown in the drawings, the press-fitting section 9*b* comprising a projection so as to protrude from the outer periphery is provided on the outer periphery of shaft section 9*g* of adjustment dial 9, and a locking section 1*c* in which the press-fitting section 9*b* is press-fit and retained is provided on the lower end of an adjustment dial insertion hole 1*b*. Furthermore, during adjustment of settling current, settling current is adjusted by inserting a screwdriver into a current adjustment hole 9*d* provided in a head section 9*c* of adjustment dial 9 and rotating adjustment dial 9. In addition, the screwdriver is rotated so as to align a current settling scale 9*e* provided on head section 9*c* of adjustment dial 9 for representing a settling current set value with an indicated value not shown provided on external case 1.

As shown in FIG. 4, adjustment dial 9 is inserted into adjustment dial insertion hole 1*b* of external case 1 by press fitting a press-fitting section 9*b* provided on the outer periphery of adjustment dial 9 into adjustment dial insertion hole 1*b* provided in external case 1. At that time, together with the press-fitting section 9*b* being press-fit and retained by the lower end of adjustment dial insertion hole 1*b*, adjustment dial 9 can be prevented from coming out. Since, as shown in FIG. 5, the press-fit and retained press-fitting section 9*b* of adjustment dial 9 generates force in the direction of F with respect to locking section 1*c*, adjustment dial 9 can be stably retained at a fixed position without becoming loose. In addition, as shown in FIG. 5, forming a chambered section (inclined section) 1*d* on locking section 1*c* of external case 1 facilitates insertion of adjustment dial 9 into adjustment dial insertion hole 1*b*.

Figure 6:
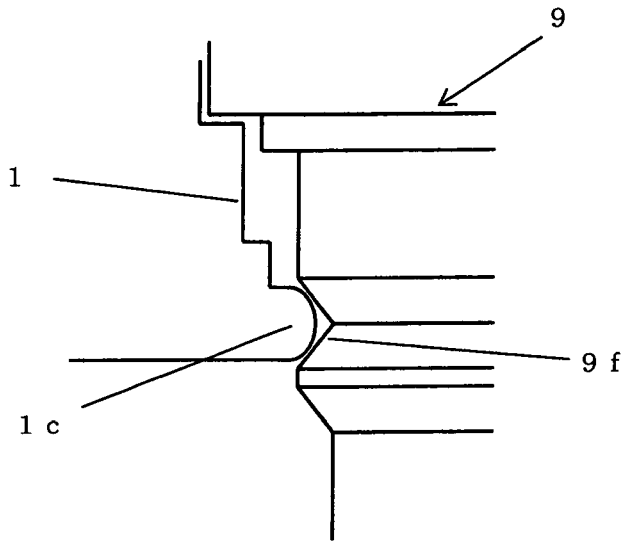
FIG. 6 is a cross-sectional view of an adjustment dial indicating a second embodiment of the present invention.
Figure 7:
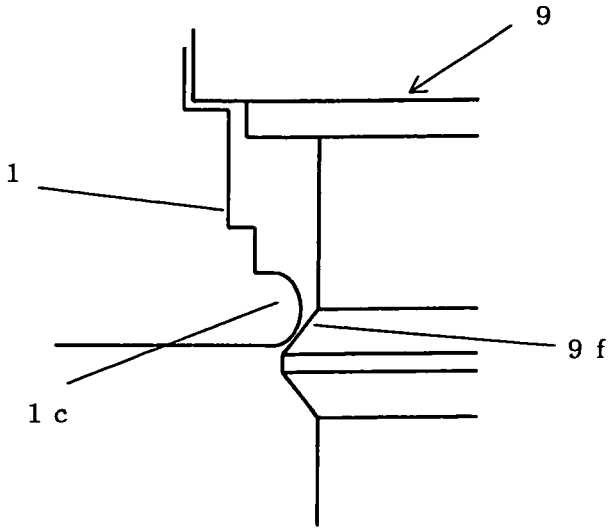
FIG. 7 is a cross-sectional view of an adjustment dial indicating a third embodiment of the present invention.

In addition, FIGS. 6 and 7 indicate other embodiments of the present invention. FIGS. 6 and 7 are cross-sectional views showing the incorporated state of an adjustment dial press-fit and retained in an adjustment dial insertion hole provided in an external case.

Although a press-fit section 9*b* is provided on the outer periphery of adjustment dial 9 and a locking section 1*c* is provided on the lower end of adjustment dial insertion hole 1*b* provided in external case 1 in the previously described embodiment, as shown in FIGS. 6 and 7, a press-fitting section similar to press-fitting section 9*b* of adjustment dial 9 may be provided on for locking section 1*c* on the lower end of adjustment dial insertion hole 1*b* provided in external case 1, and locking section 9*f* may be provided on adjustment dial 9.

Figure 8:
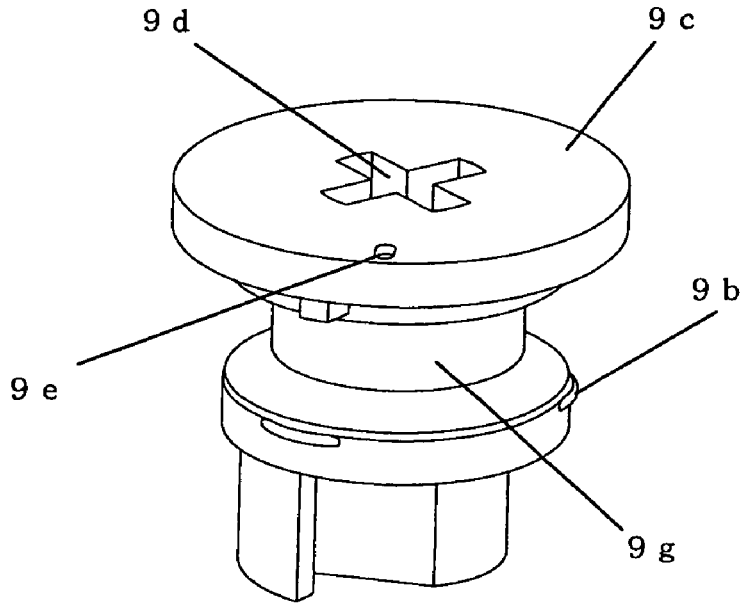
FIG. 8 is a perspective view of an adjustment dial indicating a fourth embodiment of the present invention.

FIG. 8 shows an adjustment dial 9 indicating another embodiment of the present invention, and in this embodiment, three or more press-fitting sections 9*b* are provided on the outer periphery of adjustment dial 9, thereby facilitating press fitting of adjustment dial 9 into adjustment dial insertion hole 1*b* provided in external case 1. Furthermore, the method for press fitting adjustment dial 9 into adjustment dial insertion hole 1*b* of external case 1 is the same as that of the embodiment of FIG. 4.

Figure 9:
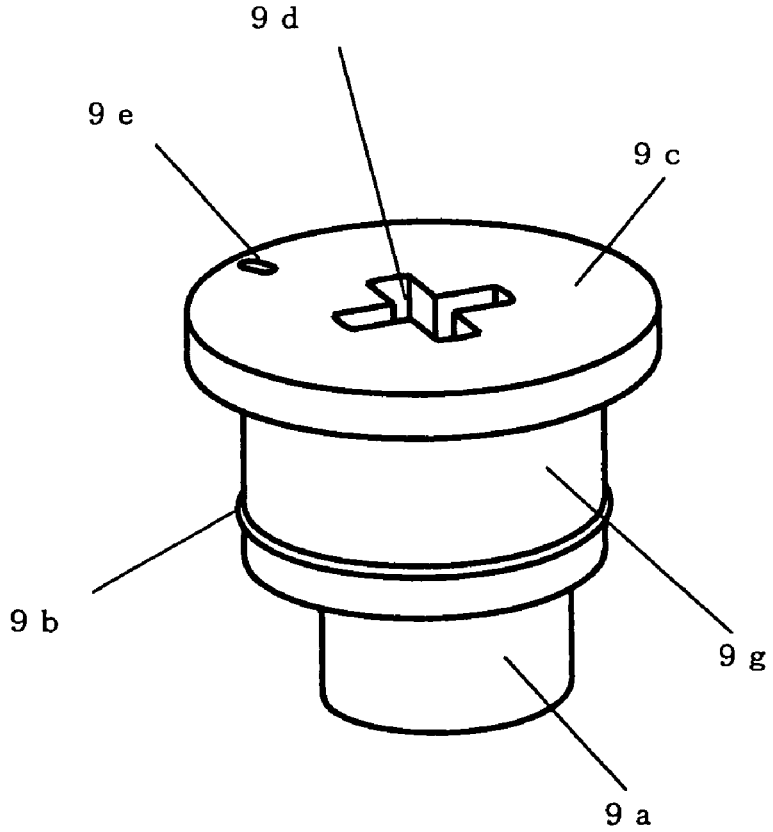
FIG. 9 is a perspective view of an adjustment dial showing a fifth embodiment of the present invention.
Figure 10A:
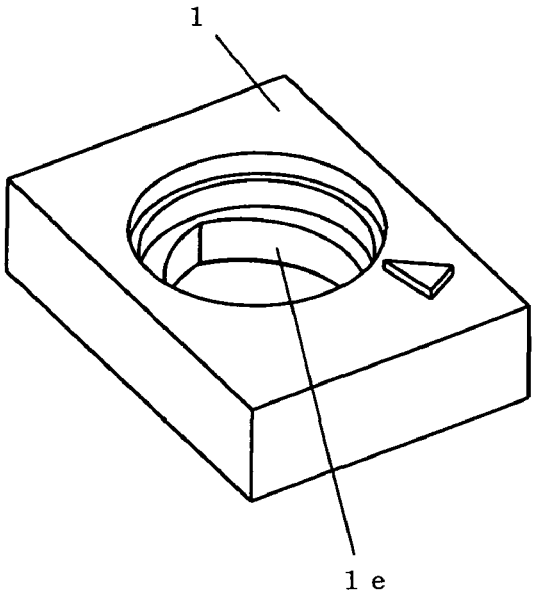
FIG. 10A is a perspective view and FIG. 10B is a cross-sectional view of an external case showing a fifth embodiment of the present invention.
Figure 10B:
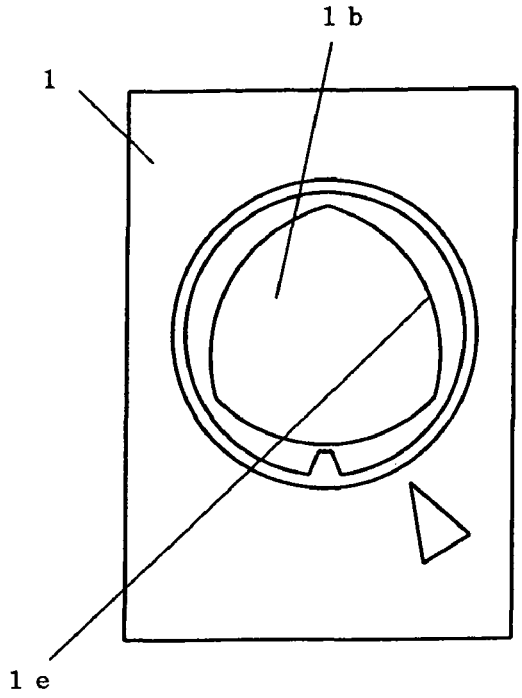
Figure 11:
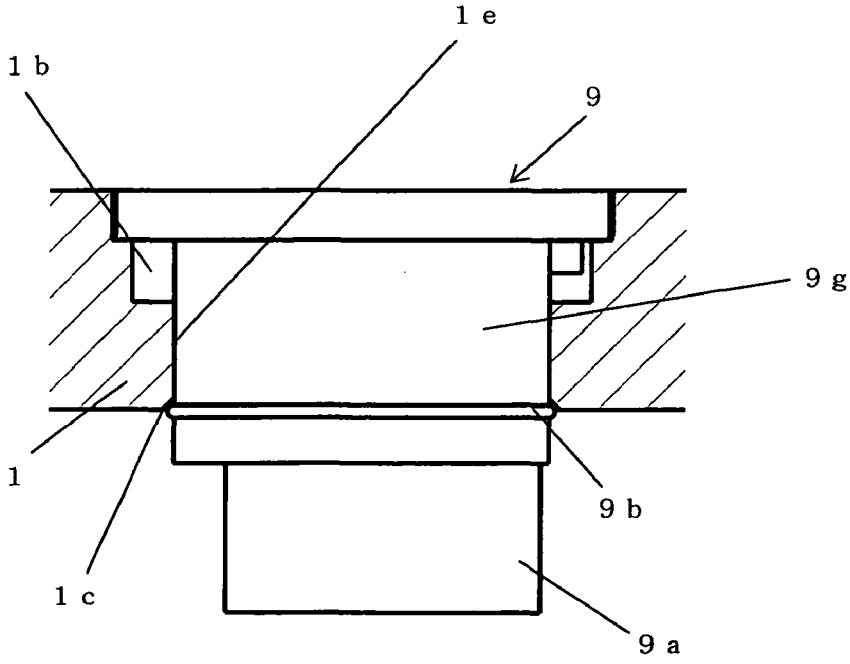
FIG. 11 is a cross-sectional view showing the adjustment dial shown in FIGS. 9, 10A and 10B engaged with the external case.
Figure 12:
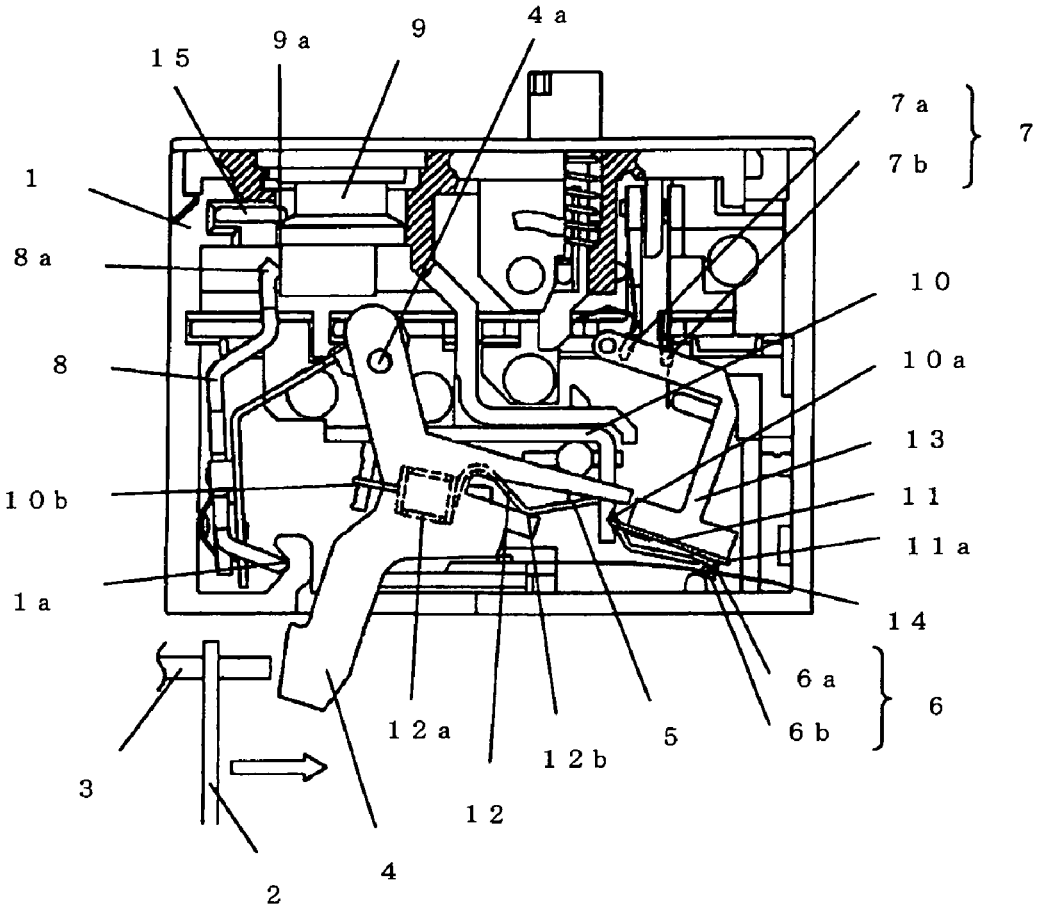
FIG. 12 PRIOR ART
FIG. 12 is an internal structural drawing of a thermal overload relay indicating an example of the prior art.
Figure 13:
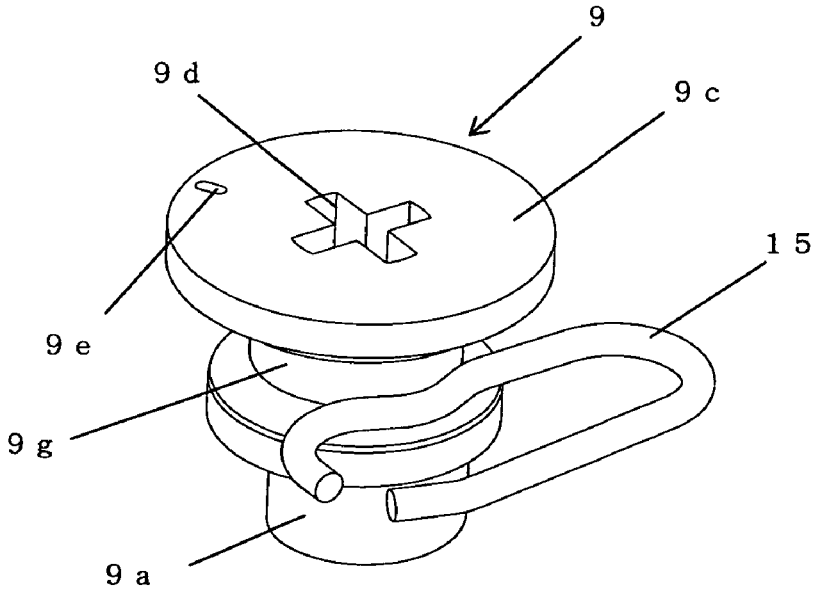
FIG. 13 PRIOR ART
FIG. 13 is a perspective view showing a method of fixing an adjustment dial indicating an example of the prior art.

FIGS. 9 to 11 show another embodiment of the present invention.

FIG. 9 is a perspective view of an adjustment dial showing another embodiment of the present invention, FIG. 10A is a perspective view of an external case showing another embodiment thereof, FIG. 10B is an overhead view of the external case shown in FIG. 10A, and FIG. 11 is a cross-sectional view showing an adjustment dial indicating another embodiment of the present invention press-fit and retained in an adjustment dial insertion hole provided in an external case.

Namely, in the embodiment shown in the drawings, the press-fitting section 9*b* comprising a projection so as to protrude from the outer periphery is provided on the outer periphery of the shaft section 9*g* of adjustment dial 9. Here, the shaft section 9*g* of the adjustment dial 9 shown in FIG. 9 may have a smaller diameter dimension in the manner of the shaft section 9*g* of the adjustment dial 9 shown in FIG. 1, or may have the same diameter dimension as the head section 9*c* of the adjustment dial 9. In addition, in the adjustment dial insertion hole 1*b* of the external case 1 shown in FIGS. 10A and 10B, the hole of an adjustment dial contact surface 1*e* where the shaft section 9*g* of the adjustment dial 9 contacts the external case 1 has a triangular shape having a circular arc. Incidentally, the shape of the hole of the adjustment dial contact surface 1*e* of the adjustment dial insertion hole is limited to a triangular shape in the present embodiment, but a polygonal insertion hole may also be employed.

As shown in FIG. 11, the adjustment dial 9 is press-fit into the adjustment dial contact surface 1*e* in which the adjustment dial insertion hole 1*b* provided in the external case 1 is in the form of a triangular hole by inserting the press-fitting section 9*b* of the adjustment dial 9 into the adjustment dial insertion hole 1*b* provided in the external case 1. At that time, together with the press-fitting section 9*b* being press-fit and retained by the lower end of the adjustment dial contact surface 1*e* of the adjustment dial insertion hole 1*b*, the adjustment dial 9 can be prevented from coming out. As a result, the adjustment dial 9 is retained at three points, and can be stably retained at a fixed position without becoming loose. In addition, since the shaft section 9*g* of the adjustment dial 9 contacts the adjustment dial contact surface in which the adjustment dial insertion hole 1*b* provided in the external case 1 is in the form of a triangular hole, frictional resistance increases thereby also demonstrating the effect of preventing erroneous rotation of the adjustment dial 9.

The disclosures of Japanese Patent Applications No. 2008-37106 filed on Feb. 19, 2008 and No. 2008-259294 filed on Oct. 6, 2008 are incorporated as reference.

While the invention has been explained with references to the specific embodiments of the invention, the explanation is illustrative and the invention is limited only by the appended claims.

What is claimed is:

1. A thermal overload relay, comprising:

an external case having an adjustment dial insertion hole, an adjustment dial having a head section with an adjustment hole in an upper surface, a shaft section extending downwardly from a lower surface of the head section, a cam integral with the shaft section, the cam being located at a lower end of the shaft section and inserted into the adjustment dial insertion hole for adjusting a settling current, a radially configured press-fitting section provided on the shaft section between the cam and the head section, and a locking section provided in the adjustment dial insertion hole, said press-fitting section being press-fit and retained at the locking section.

2. The thermal overload relay according to claim 1, wherein the press-fitting section is provided on the shaft section, and the locking section is provided around the adjustment dial insertion hole of the external case.

3. The thermal overload relay according to claim 2, wherein the press-fitting section provided on the shaft section is a projection provided on an outer periphery of the shaft section which contacts the locking section of the external case.

4. The thermal overload relay according to claim 2, wherein the locking section provided on the external case is a chambered section.

5. The thermal overload relay according to claim 3, wherein the projection provided on the shaft section is provided around the entire outer periphery.

6. The thermal overload relay according to claim 1, wherein the head section has greater radial dimensions than the cam.

7. The thermal overload relay according to claim 1, wherein the adjustment dial insertion hole has a recess at one end into which the head section seats.

8. The thermal overload relay according to claim 1, wherein the press-fitting section comprises a recess in the shaft section into which the locking section is received.

9. The thermal overload relay according to claim 1, wherein the press-fitting section is a projection, and the locking section is a groove or projection formed in the adjustment dial insertion hole.

10. A thermal overload relay, comprising:

an external case having an adjustment dial insertion hole, an adjustment dial with a cam inserted into the adjustment dial insertion hole for adjusting a settling current, a press-fitting section provided at one of the adjustment dial and the adjustment dial insertion hole, and a locking section provided at the other of the adjustment dial and the adjustment dial insertion hole, said press-fitting section being press-fit and retained at the locking section, wherein the press-fitting section is provided on the adjustment dial, and the locking section is provided around the adjustment dial insertion hole of the external case, wherein the press-fitting section provided on the adjustment dial is in a form of a projection provided on an outer periphery of the adjustment dial contacting the locking section of the external case, and wherein the press-fitting section of the adjustment dial includes at least three projections spaced at equal intervals on the outer periphery thereof.

11. A thermal overload relay, comprising:

an external case having an adjustment dial insertion hole, an adjustment dial with a cam inserted into the adjustment dial insertion hole for adjusting a settling current, a press-fitting section provided at one of the adjustment dial and the adjustment dial insertion hole, and a locking section provided at the other of the adjustment dial and the adjustment dial insertion hole, said press-fitting section being press-fit and retained at the locking section, wherein the press-fitting section is provided on the adjustment dial, and the locking section is provided around the adjustment dial insertion hole of the external case, and wherein the adjustment dial insertion hole has a triangular shape, and includes an adjustment dial contact surface in a form of a locking section provided on the external case.

12. The thermal overload relay according to claim 11, wherein the adjustment dial has a shaft section having a size sufficient to contact a peripheral wall of the adjustment dial insertion hole.

* * * * *